US006736389B2

(12) United States Patent
Kosmoski

(10) Patent No.: US 6,736,389 B2
(45) Date of Patent: May 18, 2004

(54) PICK-ROLLER DRIVE DISENGAGEMENT SCHEME

(75) Inventor: Jeffrey P. Kosmoski, Beaverton, OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/195,176

(22) Filed: Jul. 15, 2002

(65) Prior Publication Data

US 2004/0007808 A1 Jan. 15, 2004

(51) Int. Cl.[7] ..... B65H 3/06
(52) U.S. Cl. ..... 271/116; 271/114; 271/110
(58) Field of Search ..... 271/10.03, 10.11, 271/110, 114, 116, 117, 118

(56) References Cited

U.S. PATENT DOCUMENTS 3,910,567 A * 10/1975 Songer ..... 271/42
4,141,545 A * 2/1979 Schnall et al. ..... 271/118
4,290,593 A * 9/1981 Irvine ..... 271/42
4,319,740 A * 3/1982 Ulseth ..... 271/22
6,116,589 A * 9/2000 Bortolotti ..... 271/121
6,209,862 B1 * 4/2001 Kelley ..... 271/18
6,322,065 B1 * 11/2001 Underwood et al. ..... 271/117
6,637,743 B2 * 10/2003 Underwood et al. ..... 271/117

* cited by examiner

*Primary Examiner*—Donald P. Walsh
*Assistant Examiner*—Matthew J. Kohner
(74) *Attorney, Agent, or Firm*—Fay, Sharpe, Fagan, Minnich & McKee, LLP

(57) ABSTRACT

A sheet feeder (14) for a print engine (10) includes a paper tray (30) which holds a stack of sheets (22) including a top sheet (20), and a pick-roller (42) which makes contact with the top sheet (20). The pick-roller (42) is rotatable about an axis. Also included is a driver (44), which upon forward energizing, rotationally drives the pick-roller (42) about the axis in a forward direction to advance the top sheet (20) to sheet advancing means (34) that pass the top sheet (20) along through the print engine (10). A drive controller (50) controls the driver (44). The drive controller (50) causes the pick-roller (42) to be released for free-wheeling after advancing the top sheet (20) to the sheet advancing means (34).

19 Claims, 2 Drawing Sheets

PICK-ROLLER DRIVE DISENGAGEMENT SCHEME

FIELD OF THE INVENTION

The present invention relates to the printing and/or copying arts. It finds particular application in conjunction with sheet feeders for printers, copiers, etc., and will be described with particular reference thereto. However, it is to be appreciated that the present invention is also amenable to other like applications, marking devices, and/or print engines, e.g., facsimile machines, multi-function peripherals/printers (MFPs), etc.

BACKGROUND OF THE INVENTION

In the case of copiers, printers and the like (hereinafter all referred to generally as print engines), often a sheet feeder is employed to supply sheets of paper, transparencies, or other like media to a marking device or engine where toner, ink or the like is applied thereto in accordance with an input image or data. Typically, it is desired to select one sheet at a time from a stack of sheets in a paper tray of the sheet feeder. Nevertheless, a problem exists, known as multi-pick, whereby a plurality (e.g., two or three or sometimes even more) sheets are picked from the sheet feeder's paper tray at one time. Multi-picks tend to be most prevalent when the stack of sheets is low or the paper tray is near empty. Multi-picks result when the attractive force (e.g., caused by compression together, friction, static, etc.) between a top sheet in the stack and an underlying sheet or sheets is not overcome as the top sheet is advanced from the sheet feeder. If the force is not overcome, the underlying sheet or sheets is/are advanced from the sheet feeder along with the top sheet, hence, a multi-pick results.

In general, it is known in the art to use pick-roller systems to select or pick sheets from the paper tray of the sheet feeder. However, due to the design and/or operation of previously developed pick-roller systems, they still undesirably experience multi-picks at times. Accordingly, it is remains desirable to have a pick-roller assembly and/or method which suitably inhibits multi-picks.

The present invention contemplates a new and improved pick-roller driver and/or pick-roller method which overcomes the above-referenced problems and others.

SUMMARY OF THE INVENTION

In accordance with an aspect of the present invention, a sheet feeder is provided for a print engine. The sheet feeder includes a paper tray which holds a stack of sheets including a top sheet, and a pick-roller which makes contact with the top sheet. The pick-roller is rotatable about an axis. Also included is a driver, which upon forward energizing, rotationally drives the pick-roller about the axis in a forward direction to advance the top sheet to sheet advancing means that pass the top sheet along through the print engine. A drive controller controls the driver. The drive controller causes the pick-roller to be released for free-wheeling after advancing the top sheet to the sheet advancing means.

In accordance with another aspect of the present invention, a method is provided for feeding sheets out of a sheet feeder to a print engine. The method includes: holding a plurality of sheets; contacting one of the plurality of sheets with a rotary member; selectively rotating the rotary member in a first direction such that the sheet in contact therewith advances to sheet advancing means that pass it along through the print engine; and, releasing the rotary member for free-wheeling upon the advanced sheet reaching the sheet advancing means.

In accordance with yet another aspect of the present invention, a sheet feeding device includes: holding means for holding a plurality of sheets; sheet advancing means for passing sheets from the sheet feeding device along through an associated print engine; rotary means for advancing one of the plurality of sheets from the holding means to the sheet advancing means; drive means for rotating the rotary means in a first direction thereby advancing the sheet from the holding means to the sheet advancing means; and, control means for controlling the drive means. The control means causes the rotary means to be released for free-wheeling when the sheet advanced by the rotary means reaches the sheet advancing means.

In accordance with still another aspect of the present invention, a print engine includes a marking engine which applies marks to sheets of media supplied thereto and a feeding device which supplies the sheets to the marking engine. The sheet feeding device includes: a paper tray which holds a plurality of sheets; a pick-roller which makes contact with one of the plurality of sheets; a driver, which upon forward energizing, rotationally drives the pick-roller to advance the sheet in contact therewith to sheet advancing means that pass it from the feeding device to the marking engine; and, a drive controller which controls the driver. The drive controller causes the pick-roller to be released for free-wheeling after advancing the sheet to the sheet advancing means.

One advantage of the present invention is that it provides suitable sheet feeding for print engines while guarding against multi-picks.

Still further advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention. Further, it is to be appreciated that the drawings are not to scale.

DETAILED DESCRIPTION OF THE INVENTION

Figure 1:
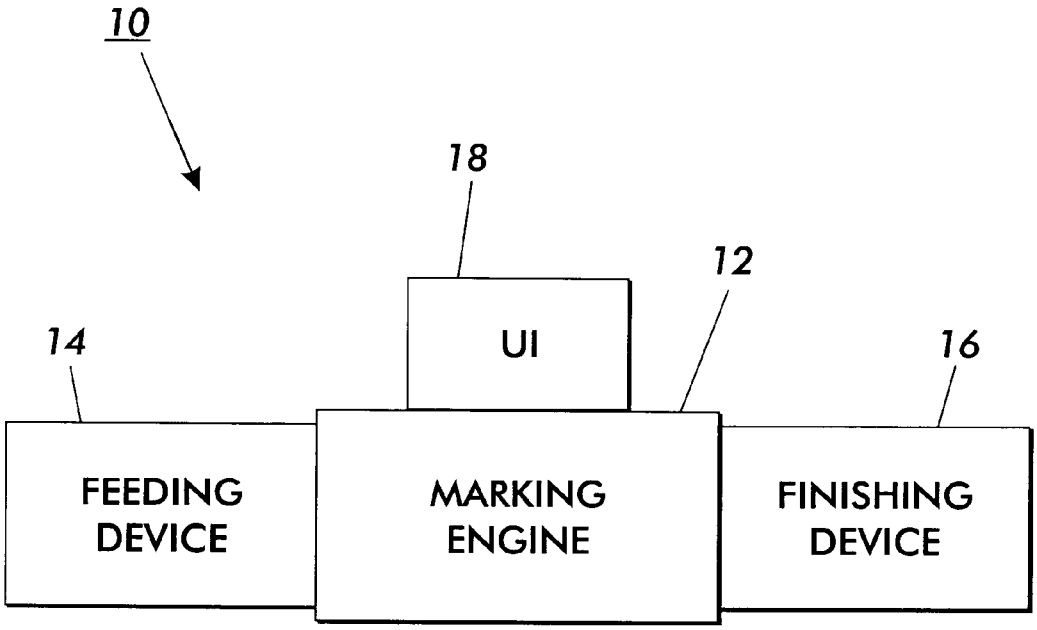
FIG. 1 is a diagrammatic illustration showing an exemplary print engine in accordance with aspects of the present invention.

With reference to FIG. 1, a print engine 10 preferably includes a marking engine or device 12, a feeding device or sheet feeder 14, an optional finishing device 16, and a user interface (UI) 18. The print engine 10 may be a printer, copier, facsimile machine, MFP or other like apparatus as is known in the art. In accordance with originals or data input into the print engine 10, the marking engine or device 12 applies ink, toner or the like to sheets of paper or other media (e.g., transparencies) supplied thereto by the sheet feeder 14. The print engine 10 and/or marking device 12 may employ digital, analog, color, monochromatic, optical, laser, ink jet, xerographic, electroreproductive, electrophotographic and/or other technologies known in the art to generate appropriately marked sheets which are output to the optional finishing device 16. The finishing device 16 receives output sheets from the marking device 12 and preferably conducts one or more selected or otherwise determined finishing operations thereon, e.g., gathering, sorting, collating, stacking, stapling, binding, stitching, folding, cutting, hole punching, etc. Optionally, one or more sheet feeders 14 may be include, e.g., to supply different sizes or types of paper and/or other media. However, for purposes of simplicity and clarity, only one shall be considered herein.

As stated, the print engine 10 also preferably includes the UI 18 which allows the user or operator to control the print engine 10 and/or monitor it's operation. The UI 18 is preferably a graphical UI (GUI) or other UI as is known in the art. It may be menu driven, command driven, etc. and can incorporate or utilize various folders, windows, icons, etc. The UI 18 is preferably implemented via a touch sensitive liquid crystal display (LCD), a control panel including a keypad and display device combination, and/or other suitable input/output (I/O) devices.

Figure 2:
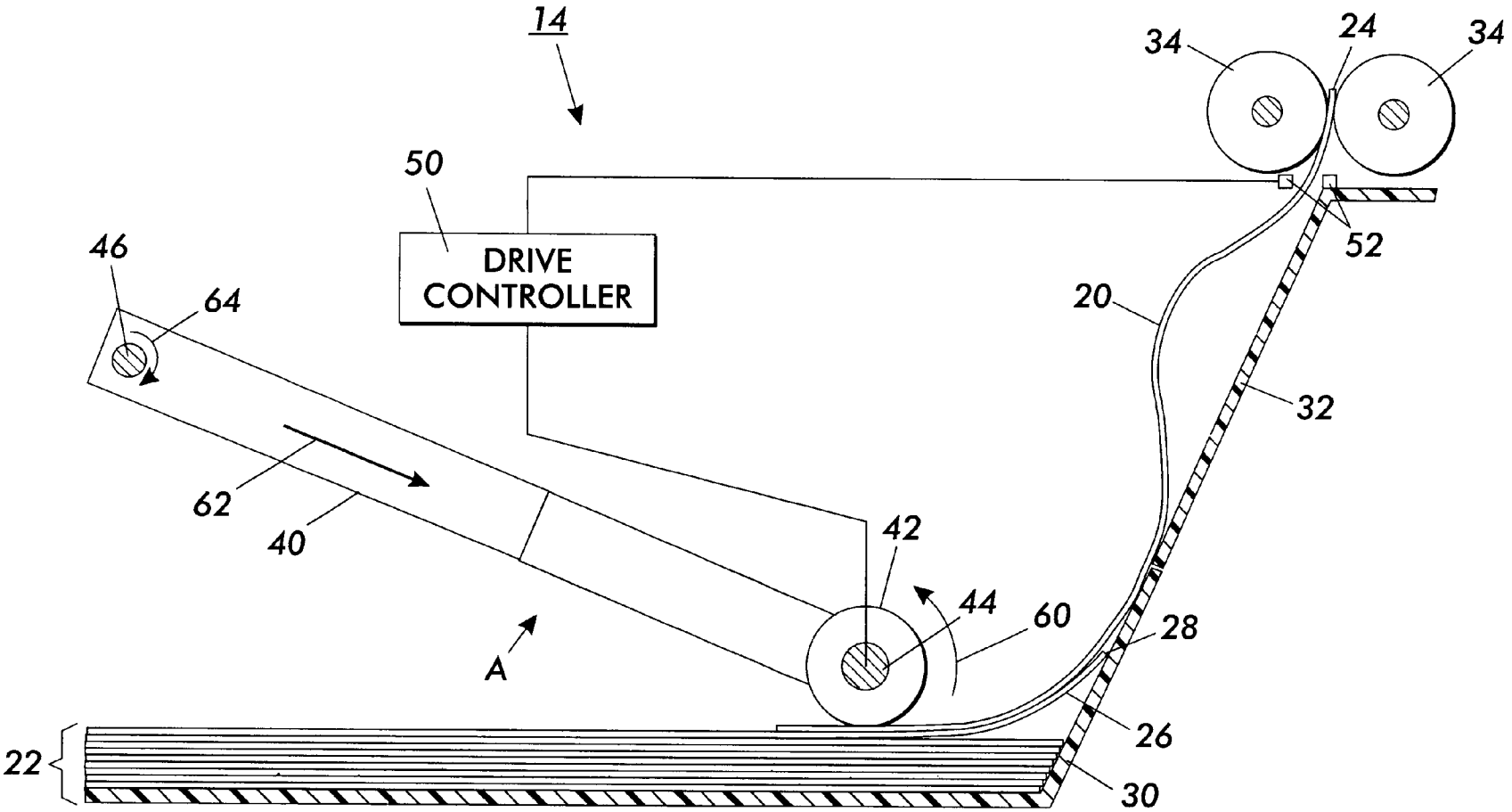
FIG. 2 is a diagrammatic illustration showing an exemplary sheet feeder in accordance with aspects of the present invention.

With reference to FIG. 2, and continuing reference to FIG. 1, the sheet feeder 14 includes a pick-roller assembly A which picks a top sheet 20 from a stack 22 of sheets in a paper tray 30 and advances it up ramp 32 to transport rollers 34. Optionally, the transport rollers 34 may be replaced and/or supplemented with any other type of sheet transport device as is known in the art. As used herein, the right and left of the paper tray 30 as shown in FIG. 2 shall nominally be referred to as the front and rear, respectively.

The pick-roller assembly A preferably includes a pick-arm 40, pick-roller 42, driver 44 and anchor 46. The pick-roller 42 is rotatably secured to a first end of the pick-arm 40. At a second end (opposite the first end), the pick-arm 40 is pivotally secured to the sheet feeder 14 by the anchor 46. The pick-roller 42 is rotationally driven about its axis by a driver 44, such as an electric motor or the like, under the control of a drive controller 50. The drive controller 50 is preferably implemented via hardware (e.g., a microprocessor, electric circuit, or the like), software, or a combination of both hardware and software.

As shown, the pick-arm 40 is a multi-section telescoping member which can expand and contract longitudinally. Alternately, the anchor 46 is arranged to permit the pick-arm 40 to move horizontally forward (i.e., toward the right as shown in FIG. 2) and backward (i.e., toward the left as shown in FIG. 2). In either case, with respect to its movement during operation, the effect on the pick-roller 42 during operation of the pick-roller assembly A is generally the same.

In accordance with a suitable embodiment of the present invention, operation of the sheet feeder 14 is as follows. For purposes of the present example, assume the top sheet 20 which is next to be fed is lying flat in the paper tray 30 along with the rest of the stack 22. When a sheet is called for or it is otherwise determined that sheet 20 is to be picked and/or fed from the sheet feeder 14, the drive controller 50 signals the driver 44 which is energized to rotationally drive the pick-roller 42 in a forward direction, as indicated in FIG. 2 by arrow 60. Accordingly, as a result of the pick-roller's forward rotation and the friction between the pick-roller 42 and the top sheet 20, the top sheet 20 advances forward (i.e., from left to right) in the paper tray 30. Eventually, a leading edge 24 of the forwardly advancing top sheet 20 bends or turns upward and is pushed up the ramp 32 by the forwardly driven pick-roller 42 until it reaches and is securely engaged within and/or by the transport rollers 34.

As the forwardly driven pick-roller 42 is advancing the top sheet 20 forward, the pick-roller assembly A is recoiling against a resilient force that urges the pick-roller 42 toward the front of the paper tray 30. As shown in FIG. 2, the resilient force is in the direction of arrow 62, and is optionally the result of a compressed spring or the like within the telescoping pick-arm 40. The recoiling results in the pick-arm 40 longitudinally compressing and pivoting around the anchor 46 in the direction of arrow 64. Consequently, the pick-roller 42 moves horizontally against the resilient force toward the rear of the paper tray 30, and is maintained and/or urged down against the top sheet 20 thereby providing an appropriate amount of fictional contact therewith. Depending on the type of stock, flexibility, thickness, etc. of sheets in the stack 22 and the particular embodiment, the pick-roller 42 may move a total of anywhere from 4 to 5 inches rearward of its otherwise at-rest position.

Once the leading edge 24 is engaged with and/or in the transport rollers 34, the drive controller 50 signals the driver 44 to de-energize the same thereby halting forward driving of the pick roller 42. Additionally, the drive controller 50 signals the driver 44 to release the pick-roller 42 so that it can free-wheel about its rotational axis. Optionally, a detector or sensor 52 of any suitable type known in the art is used to determine when the transport rollers 34 have engaged or otherwise received the leading edge 24 of sheet 20. A signal from the detector or sensor 52 is communicated, either directly or indirectly, to the drive controller 50 such that the de-energizing of the driver 44 and release of the pick-roller 42 are appropriately timed.

Preferably, the pick-roller 42 is released for free-wheeling by the drive controller 50 signaling the driver 44 so that it is energized briefly in the reverse direction, i.e., as would rotate the pick-roller 42 in the reverse direction (opposite arrow 60 shown in FIG. 2). Reverse energizing the driver 44 disengages a clutch or clutch like mechanism which otherwise essentially blocks the pick-roller 42 from free-wheeling. Once the pick-roller 42 is free-wheeling, the resilient force (indicated by arrow 62) is essentially unopposed. Consequently, the resilient force returns the pick-roller assembly A to its at-rest position. That is to say, the pick-arm 40 longitudinally expands and pivots opposite the direction of arrow 64, and the freewheeling pick-roller 42 rolls and moves horizontally toward the front of the paper tray 30.

At or about the same time the pick-roller 42 is release for free-wheeling, or just after (e.g., when the pick-roller assembly A has returned to its at-rest position), the transport rollers 34 are energized to thereby pull the top sheet 20 engaged therewith out of the sheet feeder 14 and feed it to the marking device 12 or otherwise pass it along through the print engine 10. Insomuch as the pick-roller 42 is at this time free-wheeling, the sheet 20 is free to advance thereunder unencumbered, that is, the pick-roller 42 will merely free-wheelingly rotate accordingly. Understand also, the pick-roller assembly A is being moved by the resilient force to its at-rest position, i.e., with the pick-roller 42 being toward the front of the paper tray 30. It is possible that the top sheet 20 may be getting simultaneously pulled forward by the transport rollers 34 at a different speed. However, being that the pick-roller 42 is free-wheeling, its rotational speed and/or direction can change to accommodate the sheet 20 moving thereunder. That is to say, the assembly A is free to reach the at-rest position at its own speed moving independently under the resilient force regardless of the speed at which the transport rollers 34 are pulling the top sheet 20 forward.

Consider, in contrast to the present invention, an example wherein the pick-roller 42 was not released for free-wheeling. Rather, in this contrasting example, when the pick-roller assembly A is in its rearward position, the pick-roller 42 would remain essentially locked or rotationally fixed once the leading edge 24 was engaged by the transport rollers 34. Accordingly, in this contrasting example, the pick-roller 42 then has a fixed horizontal position relative to the top sheet 20. The pick-roller assembly A in this contrasting example, therefore, is not free to independently return to its at-rest position. Rather, its return is dependent upon and/or interlocked with the advancement of the top sheet 20. That is to say, the assembly A in this contrasting example returns to its at-rest position as the pick-roller 42 is non-rotatingly translated along with the top sheet 20 being pulled by the transport rollers 34. Such an approach tends to increase the compression of and/or friction between the top sheet 20 and sheet or sheets thereunder, thereby increasing the likelihood of multi-picks.

Returning now to the present invention, preferably, the assembly A reaches its at-rest position, i.e., with the pick-roller 42 at the front of the paper tray 30, ahead of the sheet 20. That is to say, it reaches its at-rest position ahead of when it would otherwise have reached its at-rest position if the pick-roller 42 were not released for free-wheeling, i.e., as in the aforementioned contrasting example. Having the pick-roller 42 toward the front of the paper tray 30 advantageously increases the effective stiffness of the sheet 26 below the top sheet 20. By closing the distance between the pick-roller 42 (which acts as a kind of fulcrum) and the leading edge 28 of sheet 26, the likelihood of the leading edge 28 bending or otherwise turning upward is reduced, and hence, the likelihood of multi-picks is reduced.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A sheet feeder for a print engine, said sheet feeder comprising:

a paper tray which holds a stack of sheets including a top sheet;

a pick-roller which makes contact with a surface of the top sheet, said pick-roller being rotatable about an axis and reciprocally movable along a movement direction substantially parallel to the surface of the top sheet;

a driver, which upon forward energizing, rotationally drives the pick-roller about the axis in a forward direction to advance the top sheet to sheet advancing means that pass the top sheet along through the print engine; and, a drive controller which controls the driver, said drive controller causing the pick-roller to be released for free-wheeling after advancing the top sheet to the sheet advancing means.

2. The sheet feeder of claim 1, wherein the pick-roller is released for free-wheeling by reverse energizing the driver.

3. The sheet feeder of claim 1, wherein as the pick-roller is being rotationally driven in the forward direction by the driver, the pick-roller recoils in a direction opposite advancement of the top sheet.

4. The sheet feeder of claim 1, further comprising:

a pick-arm, said pick-roller being rotationally attached to a first end of the pick-arm.

5. The sheet feeder of claim 4, wherein the pick-arm is secured to the sheet feeder by an anchor at a second end of the pick-arm opposite the first end.

6. The sheet feeder of claim 5, wherein the pick-arm is pivotal about the anchor.

7. The sheet feeder of claim 1, wherein the sheet advancing means comprise a transport roller.

8. A sheet feeder for a print engine, said sheet feeder comprising:

a paper tray which holds a stack of sheets including a top sheet;

a pick-roller which makes contact with the top sheet, said pick-roller being rotatable about an axis;

a telescoping pick-arm which longitudinally expands and contracts, said pick-arm having the pick-roller attached at a first end thereof;

a driver, which upon forward energizing, rotationally drives the pick-roller about the axis in a forward direction to advance the top sheet to sheet advancing means that pass the top sheet along through the print engine; and, a drive controller which controls the driver, said drive controller causing the pick-roller to be released for free-wheeling after advancing the top sheet to the sheet advancing means.

9. A sheet feeder for a print engine, said sheet feeder comprising:

a paper tray which holds a stack of sheets including a top sheet;

a pick-roller which makes contact with the top sheet, said pick-roller being rotatable about an axis;

an expandable and contractible pick-arm having the pick-roller attached at a first end thereof, wherein a biasing force urges the pick-arm to expand;

a driver, which upon forward energizing, rotationally drives the pick-roller about the axis in a forward direction to advance the top sheet to sheet advancing means that pass the top sheet along through the print engine; and, a drive controller which controls the driver, said drive controller causing the pick-roller to be released for free-wheeling after advancing the top sheet to the sheet advancing means.

10. A method of feeding sheets out of a sheet feeder to a print engine, said method comprising:

holding a plurality of sheets;

contacting one of the plurality of sheets with a rotary member;

selectively rotating the rotary member in a first direction such that the sheet in contact therewith advances to sheet advancing means that pass it along through the print engine, wherein when the rotary member is rotated to advance the sheet in contact therewith, the rotary member recoils in a direction opposite advancement of the sheet; and, releasing the rotary member for free-wheeling upon the advanced sheet reaching the sheet advancing means.

11. The method of claim 10, further comprising:

biasing the rotary member to urge it in a direction opposite the direction of recoil.

12. The method of claim 10, further comprising:

detecting when the advanced sheet reaches the sheet advancing means.

13. A sheet feeding device comprising:

holding means for holding a plurality of sheets;

sheet advancing means for passing sheets from the sheet feeding device along through an associated print engine;

rotary means for advancing one of the plurality of sheets from the holding means to the sheet advancing means;

drive means for rotating the rotary means in a first direction thereby advancing the sheet from the holding means to the sheet advancing means, wherein while being driven the rotary means moves from an at-rest position to a recoiled position; and, control means for controlling the drive means, said control means causing the rotary means to be released for free-wheeling when the sheet advanced by the rotary means reaches the sheet advancing means.

14. The sheet feeding device of claim 13, further comprising:

biasing means for returning the rotary means to the at-rest position from the recoiled position when the rotary means is released for free-wheeling.

15. The sheet feeding device of claim 14, the rotary means travels between the at-rest position and the recoiled position along a substantially linear path.

16. A sheet feeding device comprising:

holding means for holding a plurality of sheets;

sheet advancing means for passing sheets from the sheet feeding device along through an associated marking engine;

rotary means for advancing one of the plurality of sheets from the holding means to the sheet advancing means;

drive means for rotating the rotary means in a first direction thereby advancing the sheet from the holding means to the sheet advancing means;

biasing means for returning the rotary means to an at-rest position from a recoiled position achieved when the rotary means advances one of the plurality of sheets, wherein the biasing means comprise a variable length pick-arm having the pick-roller rotatably attached to an end thereof; and, control means for controlling the drive means, said control means causing the rotary means to be released for free-wheeling when the sheet advanced by the rotary means reaches the sheet advancing means.

17. The sheet feed device of claim 16, wherein the associated marking engine is an electrophotograpic device.

18. A print engine comprising:

a marking engine which applies marks to sheets of media supplied thereto; and a feeding device which supplies the sheets to the marking engine, said sheet feeding device including:

a paper tray which holds a plurality of sheets;

a pick-roller which makes contact with one of the plurality of sheets;

a driver, which upon forward energizing, rotationally drives the pick-roller to advance the sheet in contact therewith to sheet advancing means that pass it from the feeding device to the marking engine; and, a drive controller which controls the driver, said drive controller causing the pick-roller to be released for free-wheeling after advancing the sheet to the sheet advancing means, wherein the pick-roller is released for free-wheeling by a brief reverse energizing of the driver, said brief reverse energizing lasting for a period of time shorter than a period of time during which the pick-roller is released for free-wheeling.

19. The print engine of claim 18, wherein the feeding device further comprises:

a pick-arm, said pick-roller being rotationally attached to a first end of the pick-arm.

* * * * *